US006346368B1

(12) United States Patent
Irie

(10) Patent No.: US 6,346,368 B1
(45) Date of Patent: Feb. 12, 2002

(54) SILVER HALIDE LIGHT SENSITIVE COLOR REVERSAL PHOTOGRAPHIC MATERIAL

(75) Inventor: Yasushi Irie, Hino (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 09/621,454

(22) Filed: Jul. 21, 2000

(30) Foreign Application Priority Data

Jul. 23, 1999 (JP) ..... 11-209136

(51) Int. Cl.[7] ..... G03C 1/46

(52) U.S. Cl. ..... 430/505; 430/506; 430/507; 430/502; 430/503; 430/379

(58) Field of Search ..... 430/502, 503, 430/505, 506, 567, 379

(56) References Cited

U.S. PATENT DOCUMENTS 5,437,966 A * 8/1995 Haraga et al. ..... 430/505

* cited by examiner

*Primary Examiner*—Geraldine Letscher
(74) *Attorney, Agent, or Firm*—Finnegan, Henderson, Farabow, Garrett & Dunner, L.L.P.

(57) ABSTRACT

A silver halide color reversal photographic material is disclosed, comprising a support having thereon a blue-sensitive silver halide emulsion layer containing a yellow dye-forming coupler, a green-sensitive silver halide emulsion layer containing a magenta dye-forming coupler and a red-sensitive silver halide emulsion layer containing a cyan dye-forming coupler, wherein a RMS value at a density of 0.8 of the red-sensitive layer is within a range of 20 to 90% of a RMS value at a density of 0.8 of the green-sensitive layer.

11 Claims, No Drawings

SILVER HALIDE LIGHT SENSITIVE COLOR REVERSAL PHOTOGRAPHIC MATERIAL

FIELD OF THE INVENTION

The present invention relates to silver halide light sensitive color reversal photographic materials improved in image quality, specifically suitable for nature photography, and in particular to silver halide color reversal photographic materials which are improved in graininess, sharpness, color reproduction and camera speed so as to be suitable for capturing images of nature.

BACKGROUND OF THE INVENTION

Recently, silver halide color photographic materials have made marked enhancement in image quality. Barring troubles in photographing, such as camera-shake, sufficiently satisfactory quality pictures for enjoyment by amateurs in daily life can be provided at a low price.

Along with advancement of age in the opulation constitution, advanced amateurs using high quality color negative films or silver halide color reversal photographic light sensitive materials (hereinafter, also denoted simply as color reversal photographic materials or color reversal films), which have been said to need to know how to use them, have increased opportunities for participating in a photography course, photography club or photography competition as a lifelong hobby. Accordingly, improved silver salt photographic materials with higher quality are continuously sought.

Similarly to professional photographers, such amateurs are often very critical in checking the quality of their finished images and are very insistent in their desire for creating their own works.

Such user's liking depends strongly on their individual insistence, so that photography goods satisfying the general public are needed, whereas providing a film characterized of specific performance is recognized as a commercial value. Accordingly, development of technical means for providing goods having such a high quality feature and practical use thereof are increasingly desired. Specifically, color reversal film is not only a recording medium for photographing but also has a display function, characterized in that various values can be easily added.

In cases when performing various characterization (value added) in color reversal films, from what view point designation is made is important, as well as improvements in graininess, sharpness and color reproduction as an imaging element. Studio photographs, for example, in which an object is relatively stable with respect to light amount and light quality are different in design concept from photographs taken at the seashore under the broiling sun.

Techniques for improving graininess, sharpness and color reproduction have been proposed, based on the concept of high added value being equal to high image quality. However, there is no proposal with respect to the potential is designed and in practice, a value added which meets concrete user's needs was not indicated.

As a technique for improving graininess, for example, is generally known a technique of making silver halide grains smaller, based on a technique for enhancing sensitivity of the grains. The use of tabular silver halide grains as a technique for enhancing sensitivity is described in U.S. Pat. Nos. 4,434,226, 4,439,520, 4,414,310, 4,433,048, 4,414,306 and 4,459,353; JP-A 58-111935, 58-111936, 58-111937, 580113927 and 59-99433 (herein, the term, JP-A means an unexamined and published Japanese Patent Application). Further, JP-A 63-220238 and Japanese Patent Application No. 10-009604 disclose a technique of introducing dislocation lines into the interior of silver halide grains.

However, nothing is described in these disclosures with respect to the concrete usage of the merit of enhanced graininess. With regard to sharpness, techniques of specifying the form or amount of silver halide grains contained in a photographic material or layer thickness of the photographic material, for example, including the use of tabular silver halide grains as described in the foregoing disclosures. Further, a large number of dyes have been proposed to enhance color reproduction and sharpness, for example, including azo dyes, oxonol dyes described in British Pat. No. 506,385 and JP-B 39-22069 (herein, the term, JP-B means a published Japanese Patent), merocyanine dyes described in U.S. Pat. No. 2,493,747 and styryl dyes described in U.S. Pat. No. 1,845,404.

There are also known diffusion-proof dyes used to dye a specific layer to enhance color reproducibility, including oil-soluble disperse dyes described in U.S. Pat. Nos. 2,538,008, 2,538,009, 4,420,555, 4,940,654; JP-A 61-204630, 61-205934, 62-32460, 62-56958, 62-92949, 62-222248, 63-40143, 63-184749, 63-316852, 1-179042, 3-75632, 3-109535, 3-144438, 3-179441, 4-362634, 5-53241, 5-86056, 5-209133, 5-289239, and 5-296848.

Methods for render a dye non-diffusible by using solid particles of a water-insoluble dye are also disclosed in WO88/4,794; U.S. Pat. Nos. 4,904,565 and 4,923,788; JP-A 63-197943, 64-40827, 1-155341, 1-172828, 2-1839, 2-110453, 3-23341, 3-206443, 3-216644, 3-216645, 3-216646, 3-217838, 3-231241, 4-37740, 4-37841, 4-44033, 4-116548, 4-296848, 5-197079 and 6-110155.

Recently, nature photography is becoming more and more popular in the increasing advanced-amateur class. Accordingly, design for color reversal film suitable for nature photography is becoming increasingly important. In regard to graininess, for example, although smoothness of flesh skin tone is desired, photographing opportunities of sky are markedly large so that it is expected that the desire for enhancing quality of the latter is potentially higher. It is further expected that potential demands for sharpness and color reproducibility suitable for nature photography are also high.

SUMMARY OF THE INVENTION

It is an object of the present invention to provide a silver halide color reversal photographic material suitable for nature photography.

It is an object of the invention to provide a color reversal photographic material improved in portrayal of the sky or greenish plant leaves as an important object of nature photography and perception of depth, e.g., that of overlapping leaves The above objects can be accomplished by the following constitution:

1. A silver halide color reversal photographic material comprising a support having thereon a blue-sensitive silver halide emulsion layer containing a yellow dye-forming coupler, a green-sensitive silver halide emulsion layer containing a magenta dye-forming coupler and a red-sensitive silver halide emulsion layer containing a cyan dye-forming coupler, wherein the granularity (expressed in a RMS value) at a density of 0.8 of the red-sensitive layer is within a range of 20 to 90% of the granularity (expressed in a RMS value) at a density of 0.8 of the green-sensitive layer;

2. A silver halide color reversal photographic material comprising a support having thereon a blue-sensitive silver halide emulsion layer containing a yellow dye-forming coupler, a green-sensitive silver halide emulsion layer containing a magenta dye-forming coupler and a red-sensitive silver halide emulsion layer containing a cyan dye-forming coupler, wherein at least one of the light-sensitive layers exhibits the RMS value at a density of 0.8 within a range of 10 to 50% of the RMS value at a density of 1.6;
3. A silver halide color reversal photographic material comprising a support having thereon a blue-sensitive silver halide emulsion layer containing a yellow dye-forming coupler, a green-sensitive silver halide emulsion layer containing a magenta dye-forming coupler and a red-sensitive silver halide emulsion layer containing a cyan dye-forming coupler, wherein the sharpness at a spatial frequency of 20 lines/mm in a low density region of the red-sensitive layer is within a range of 80 to 150% of the sharpness at a spatial frequency of 20 lines/mm in a low density region of the green-sensitive layer;
4. A silver halide color reversal photographic material comprising a support having thereon a blue-sensitive silver halide emulsion layer containing a yellow dye-forming coupler, a green-sensitive silver halide emulsion layer containing a magenta dye-forming coupler and a red-sensitive silver halide emulsion layer containing a cyan dye-forming coupler, wherein at least one of the green-sensitive layer and red-sensitive layer exhibits a sharpness at a spatial frequency of 20 lines/mm in a high density region within a range of 120 to 200% of a sharpness at a spatial frequency of 20 lines/mm in a low density region;
5. A silver halide color reversal photographic material comprising a support having thereon a blue-sensitive silver halide emulsion layer containing a yellow dye-forming coupler, a green-sensitive silver halide emulsion layer containing a magenta dye-forming coupler and a red-sensitive silver halide emulsion layer containing a cyan dye-forming coupler, wherein difference SG in sensitivity at a density of 1.0 of the green-sensitive layer between exposure to green light and exposure to white light and difference SR in sensitivity at a density of 1.0 of the red-sensitive layer between exposure to red light and exposure to white light meet the following requirement:

$$-0.10 \leqq SG-SR \leqq 0.40;$$

6. A silver halide color reversal photographic material comprising a support having thereon a blue-sensitive silver halide emulsion layer containing a yellow dye-forming coupler, a green-sensitive silver halide emulsion layer containing a magenta dye-forming coupler and a red-sensitive silver halide emulsion layer containing a cyan dye-forming coupler, wherein a point γ of the red-sensitive layer and obtained by exposure to red light ($\gamma^R$) and a point γ of the green-sensitive layer and obtained by exposure to green light ($\gamma_G$) meet the following requirement:

$$\gamma^1 \leqq \gamma^2$$

where $\gamma^1$ is a value of $\gamma^R/\gamma^G$ at a density of 0.7 and $\gamma^2$ is a value of $\gamma^R/\gamma^G$ at a density of 2.0;

7. The silver halide color reversal photographic material described in any one of 1 to 6 above, wherein at least one of the light-sensitive layers comprises three silver halide emulsion layers different in sensitivity;
8. The silver halide color reversal photographic material described in any one of 1 to 6 above, wherein the photographic material comprises at least three blue-sensitive silver halide emulsion layers containing an yellow dye-forming coupler and different in sensitivity, at least three green-sensitive silver halide emulsion layers containing a magenta dye-forming coupler and different in sensitivity and at least three red-sensitive silver halide emulsion layers containing a cyan dye-forming coupler and different in sensitivity;
9. The silver halide color reversal photographic material described in any one of 1 to 8, wherein in the distribution of sensitivity at a density of 1.0 of the blue-sensitive layer, the sensitivity at a wavelength of 470 nm is within a range of 10 to 65% of the maximum sensitivity;
10. The silver halide color reversal photographic material described in any one of 1 to 9, wherein the photographic material exhibits an ISO speed of not less than 200.
11. A silver halide color reversal photographic material used for nature picture-taking, wherein graininess of sky tone is allowed to be in preference to that of skin tone;
12. The silver halide color reversal photographic material described in 11, wherein graininess of light sky tone is allowed to be in preference to that of deep sky tone;
13. A silver halide color reversal photographic material for nature picture-taking, wherein sharpness of red and/or green tone is allowed to be in preference in a high color density scene rather than a low color density scene;
14. A silver halide color reversal photographic material for nature picture-taking, wherein color enhancement by an interimage effect is allowed to be in preference in green color to in red color.

The present invention will be further detailed.

A measuring method for determining the granularity (hereinafter, also denoted as a RMS value) will be further described.

Densities of a measured section of a sample are scanned by a microdensitometer with an aperture scanning area of 1800 $\mu m^2$ (employing a slit dimension of 10 $\mu$m width and 180 $\mu$m length) to determine the RMS value, which is represented by a value of 1000 times the standard deviation of variation in density of the density-measuring number of at least 1000. The RMS granularity of each of the blue-sensitive layer (an yellow image), green-sensitive layer (a magenta image) and red-sensitive layer (a cyan image) is measured using Kodak Wratten filters W98, W99 and W26, respectively.

In this invention, the RMS value at a density of 0.8 of the red-sensitive layer is within a range of 20 to 90%, and preferably 20 to 80% of that of the green-sensitive layer. Further, in at least one light-sensitive layer, the RMS value at a density of 0.8 is preferably 10 to 50%, and more preferably 10 to 40% of the RMS value at a density of 1.6. In this invention, the RMS granularity at a density 0.8 of the red-sensitive layer is preferably not more than 11, and the RMS value at a density of 0.8 of the green-sensitive layer is preferably not more than 13. In this invention, the density refers to a transmission density (or transmittance density), and densities of the red-sensitive layer, green-sensitive layer and blue-sensitive layer were each measured with red light, green light and blue light, respectively, using densitometer Type 310 Status A (available from X-rite Corp.).

A method for determining the sharpness (hereinafter, also denoted as an MTF value) will be described. A sample to be used for measurement is exposed to light through a rectangular wave wedge having a density difference of 1.0 in which the spatial frequency is varied and subjected to processing according to the method described in Example 1. The MTF value at a low density region is a value obtained by measuring a test sample which has been exposed so as to give a density of 0.45 in the lower portion of the rectangular wave; and the MTF value at a high density region is a value obtained by measuring a test sample which has been exposed so as to give a density of 0.8 in the lower portion of the rectangular wave.

In this case, the printing exposure is optimally adjusted so as to meet the print density. Densities of a measured section of a sample are scanned by a microdensitometer with an aperture scanning area of 400 $\mu m^2$ (a slit width of 2 $\mu$m and a slit length of 200 $\mu$m) to determine the MTF value, which is represented by a relative value (expressed in percent) of a reproduced density difference at a spatial frequency of 20 lines/mm, based the reproduced density difference at a spatial frequency of 0.3 lines/mm being 100. The MTF value of each of the blue-sensitive layer (a yellow image), green-sensitive layer (a magenta image) and red-sensitive layer (a cyan image) is measured using Kodak Wratten filters W98, W99 and W26, respectively.

In this invention, the MTF value at a special frequency of 20 lines/mm in the low density region of the red-sensitive layer is preferably 80 to 150%, and more preferably 95 to 150%, based on the MTF value at a special frequency of 20 lines/mm in a low density region of the green-sensitive layer.

Further, at least one light-sensitive layer preferably exhibits a MTF value at a spatial frequency of 20 lines/mm in the high density region within a range of 120 to 200% (and more preferably 130 to 200%) of the MTF value at a spatial frequency of 20 lines/mm in the low density region. Furthermore, the MTF value at a spatial frequency of 20 lines/mm in the low density region of the red-sensitive layer is preferably not less than 40%; and the MTF value at a spatial frequency of 20 lines/mm in the low density region of the green-sensitive layer is preferably not less than 60%.

Next, the evaluation method of color reproduction will be described. The green exposure (i.e., exposure to green light) and the red exposure (i.e., exposure to red light) are carried out using color separation filters. Thus, the green separation exposure is carried out by using Kodak Color Compensating Filters 40G and 50G in white light exposure conditions, and the red separation exposure is carried using filters 40R and 50R in white exposure conditions.

The point-gamma ($\gamma$) is as dD/d(log E) on the commonly known D-LogE curve, so-called a characteristic curve in an abscissa of log E (in which E is exposure) and an ordinate of D (in which D is density). Thus, the point-gamma ($\gamma$) is the differential value and refers to the gradation at any point along the characteristic curve. The point-gamma and characteristic curve are detailed in T. H. James, The Theory of the Photographic Process, 4th ed. page 501–509 (Macmillan, 1977). In the case of reversal photographic materials, the characteristic curve is inversely related in the D-logE curve, compared to that of conventional negative photographic materials. Accodingly, strict speaking, the point-gamma of the reversal photographic material is to be a negative value but in this invention, it is shown as an absolute value (or a positive value).

In this invention, the characteristic curve can be determined according to the following procedure.

(1) Exposure

A photographic material is allowed to stand at a temperature of 23±5° C. and relative humidity (RH) of 50±20% for a period of at least 1 hr. Subsequently, the photographic material is subjected to exposure under the same atmosphere as described above, according to the exposure condition described in ISO 2240 (Photography-Colour reversal camera films-Determination of ISP speed); and (2) Processing The exposed photographic material is further maintained in the same atmosphere as above and processed within 6 hrs after exposure, according to the following steps:

| Step | Temperature | Time |
|---|---|---|
| First developing | 6 min. | 38° C. |
| Washing | 2 min. | 38° C. |
| Reversal | 2 min. | 38° C. |
| Color developing | 6 min. | 38° C. |
| Adjusting | 2 min. | 38° C. |
| Bleaching | 6 min. | 38° C. |
| Fixing | 4 min. | 38° C. |
| Washing | 4 min. | 38° C. |
| Stabilizing | 1 min. | Ord. temp. |
| Drying. | | |

Processing solutions used in the above steps are as follows.

| First Developer Solution | |
|---|---|
| Sodium tetrapolyphosphate | 2 g |
| Sodium sulfite | 20 g |
| Hdroquinone monosulfate | 30 g |
| Sodium carbonate (monohydrate) | 30 g |
| 1-Phenyl-4-methyl-4-hydroxymethyl-3-pyrazolidone | 2 g |
| Potassium bromide | 2.5 g |
| Potassium thiocyanate | 1.2 g |
| Potassium iodide (0.1% solution) | 2 ml |
| Water was added to make 1000 ml (and pH of 9.60). | |
| **Reversal Solution** | |
| Hexasodium nitrilotrimethylene phosphonate | 3 g |
| Stannous chloride (dihydrate) | 1 g |
| p-Aminophenol | 0.1 g |
| Sodium hydroxide | 8 g |
| Glacial acetic acid | 15 ml |
| Water to make 1000 ml (pH of 5.75) | |
| **Color Developer Solution** | |
| Sodium tetrapolyphosphate | 3 g |
| Sodium sulfite | 7 g |
| Sodium tertiary phosphate (dihydrate) | 36 g |
| Potassium bromide | 1 g |
| Potassium iodide (0.1% solution) | 90 ml |
| Sodium hydroxide | 3 g |
| Citrazinic acid | 1.5 g |
| N-ethyl-N-(β-methanesulfonamidoethyl)-3-methyl-4-aminoaniline sulfate | 11 g |

-continued

| | |
|---|---|
| 2,2-Ethylendithioethanol | 1 g |
| Water to make 1000 ml (pH of 11.70) | |
| Conditioner | |
| Sodium sulfite | 12 g |
| Sodium ethylenediaminetertaacetate (dihydrate) | 8 g |
| Thioglycerin | 0.4 g |
| Glacial acetic acid | 3 ml |
| Water to make 1000 ml (pH of 6.15) | |
| Bleaching Solution | |
| Sodium ethylenediaminetertaacetate (dihydrate) | 2 g |
| Ammonium ferric ethylenediaminetertaacetate (dihydrate) | 120 g |
| Potassium bromide | 100 g |
| Water to make 1000 ml (pH of 5.56) | |
| Fixer Solution | |
| Ammonium thiosulfate | 80 g |
| Sodium sulfite | 5 g |
| Sodium bisulfite | 5 g |
| Water to make 1000 ml (pH o 6.60) | |
| Stabilizer Solution | |
| Formalin (37 wt %) | 5 ml |
| KONIDUCKS (available from Konica Corp.) | 5 ml |
| Water to make 1000 ml (pH of 7.00). | |

In this invention, the difference (SG) in sensitivity at a density of 1.0 of the green-sensitive layer between exposure to green light and exposure to white light, and the difference (SR) in sensitivity at a density of 1.0 of the red-sensitive layer between exposure to red light and exposure to white light preferably satisfy the following requirement:, $-0.10 \leqq SG-SR \leqq 0.40$, and more preferably, $0 \leqq SG-SR \leqq 0.40$. Herein, the difference in sensitivity at a density of 1.0 between exposure to green light and exposure to white light refers to the difference of the logarithm of the exposure giving a density of 1.0 when exposed to white light minus the logarithm of the exposure giving a density of 1.0 when exposed to green light. Similarly, the difference in sensitivity at a density of 1.0 between exposure to red light and exposure to white light refers to the difference of the logarithm of the exposure giving a density of 1.0 when exposed to white light minus the logarithm of the exposure giving a density of 1.0 when exposed to red light.

The point-gamma obtained by exposure of the red-sensitive layer to red light ($\gamma^R$) and the point-gamma obtained by exposure of the green-sensitive layer to green light ($\gamma^G$) preferably meet the following requirement:

$$\gamma^1 \leqq \gamma^2, \text{ and more preferably } \gamma^2-\gamma^1 \leqq 0.1$$

where $\gamma^1$ is a value of $\gamma^R/\gamma^G$ at a density of 0.7 (i.e., a ratio of $\gamma^R$ at a density of 0.7 to $\gamma^G$ at a density of 0.7) and $\gamma^2$ is a value of $\gamma^R/\gamma^G$ at a density of 2.0 (i.e., a ratio of $\gamma^R$ at a density of 2.0 to $\gamma^G$ at a density of 2.0).

The photographic material provided with characteristics described above can be obtained by using silver halide emulsions so as to meet the purpose thereof, without applying a novel material.

A color reversal photographic material provided with granularity balance, sharpness balance, color separation sensitivity balance or color separation contrast balance can be achieved by combination of the grain size, the grain form, the internal structure, the coating amount, the iodide content, variation coefficient of grain size or the state of dislocation lines of silver halide grains used in each light-sensitive layer, or combined additions of other silver halide grains and by adding other silver halide grains in combination, and further by applying these to the red-sensitive layer, green-sensitive layer, blue-sensitive layer, or plural layers differing in sensitivity and having the same color-sensitivity.

For example, the present invention can be achieved by the use of silver halide emulsions described in Japanese Patent Application No. 10-362801. Such an emulsion is mainly comprised of silver halide tetradecahedral regular crystal grains containing dislocation lines, in which at least 50% of the grain surface is accounted for by (100) face. The silver halide grains are preferably monodisperse in grain size distribution. The distribution of the proportion of (100) face in the grain surface among grains is also preferably monodisperse. The silver halide emulsion is more preferably comprised of silver halide grains having a core/shell structure meeting the following requirement:

$$I_1 \leqq I_2$$

where $I_1$ is an average iodide content in the interior region of the grain and $I_2$ is an average iodide content in the exterior region of the grain, including a region containing dislocation lines.

In one preferred embodiment of the invention, plural light-sensitive layer having the same spectral sensitivity and different speed each contain such a regular crystal grain emulsion as described above, in which the highest-speed layer contains a tabular grain emulsion. Such embodiments will be further described later in Examples.

As one of the preferred embodiments in this invention, the spectral sensitivity distribution described in the foregoing item 8 can be accomplished by application of the combination with the foregoing items 1 through 8 and further with commonly known techniques, as disclosed in JP-A 3-264955, 3-194546, 3-255438, 3-290658 and 3-264954.

The total silver coating amount of the photographic material used in this invention is preferably not more than 7.0 g/m$^2$, more preferably 3.0 to 6.5 g/m$^2$, and still more preferably 4.0 to 6.1 g/m$^2$.

With regard to the dry layer thickness of the photographic materials used in the invention, the dry thickness of from the lower end of the light-sensitive emulsion layer nearest to the support to the upper end of the light-sensitive emulsion layer farthest from the support is preferably not more than 30 $\mu$m, and more preferably 18 to 24 $\mu$m. The dry thickness of a single green-sensitive layer is preferably 0.5 to 4 $\mu$m. Herein, the dry thickness is defined as a layer thickness which is measured under the rehumidifying condition at 23° C. and 55% RH. The layer thickness can be determined by measuring each layer thickness through macrophotography of the section of a dry sample using a scanning-type electron microscope.

At least one of the red-sensitive, green-sensitive and blue-sensitive silver halide emulsion layers of the photographic material relating to this invention preferably comprises at least two emulsion layers different in speed, i.e., high-speed and low-speed layers having the same spectral sensitivity, and more preferably three different speed layers having the same spectral sensitivity. It is still more preferred that each of the red-sensitive layer, green-sensitive layer and blue-sensitive layer comprises at least three emulsion layers.

In one preferred embodiment of this invention, the sensitivity at a wavelength of 470 nm is within a range of 10 to 65% of the maximum sensitivity, in the distribution of spectral sensitivity at a density of 1.0 of the blue-sensitive layer.

Herein, the distribution of spectral sensitivity at a density of 1.0 is the sensitivity represented as a function of wavelengths when the photographic material is exposed to light at intervals of some nm's at the wavelengths of 400 to 700 nm and sensitivity is represented by reciprocal of exposure necessary to give a density of 1.0 at each wavelength. Various kinds of means can be used to allow the spectral sensitivity distribution of the blue-sensitive layer to meet the requirement described above. Examples thereof include a means of spectrally sensitizing silver halide with a sensitizing dye exhibiting absorption in the intended wavelength region; a means of providing the intended spectral sensitivity by optimization of halide composition of silver halide grains or its distribution, without using a sensitizing dye; and a means of adjusting to the intended spectral distribution by incorporating an appropriate optical absorbent into the photographic material. Such means may be employed alone or in combination.

The ISO speed of photographic materials relating to this invention is preferably 200 or higher. In the of 200 or higher ISO speed, instruments such as lenses or tripods can be reduced, enhancing mobility in the outdoor at picture-taking of nature. Further, the selected region of the shutter speed and aperture at photographing is expanded, as compared to the case of 100 or lower ISP speed, leading to enhancing creativity of advanced amateur users.

A silver halide emulsion used in the photographic material relating to this invention is preferably monodisperse. The monodisperse silver halide emulsion refers to an emulsion in which silver halide grains having grain sizes included within ±20% of the mean grain size (which is hereinafter denoted as dm) account for at least 70%, based on the weight of the total grains. Herein, when the product of frequency of grains having a grain size of di, ni and $di^3$, i.e., $nixdi^3$ becomes a maximum value, this grain size di is defined as the mean grain size, dm (in which significant figures is three and the least figure is rounded). The grain size can be determined in such a manner that the grains are dispersed on the planar sampling plate without being overlapped, electronmicrographs thereof are taken with a magnification of 10,000 to 50,000 times, and the grain size or the projected area is measured from the electronmicrograph prints. In this case, at least 1,000 grains are selected at random.

The monodisperse emulsion used in this invention preferably exhibits the width of grain size distribution of not more than 20%, and more preferably not more than 15%, which is defined as below:

(Standard deviation of grain size/mean grain size)×100=width of grain size distribution (expressed in %).

In this case, the grain size can be determined according to the method described above and the mean grain size is based on the arithmetic average, as defined below:

$$\text{Mean grain size}=\Sigma di\cdot ni/\Sigma ni.$$

The mean grain size of silver halide grain emulsion used in this invention is preferably 0.1 to 10.0 μm, more preferably 0.2 to 5.0 μm, and still more preferably 0.3 to 3.0 μm.

The silver halide emulsion used in this invention is preferably comprised of silver iodobromide grains having a mean iodide content of 0 to 20 mol %, and more preferably 1 to 15 mol %. The silver halide emulsion grains used in this invention may contain chloride within a range of not impairing the effect of this invention. The silver halide grains preferably contain a high iodide phase in the interior of the grain. The silver halide grains may be regular crystal grains such as cubic, octahedral, tetradecahedral or tetracosahedral grains; twinned crystal grains such as tabular grains; or a mixture thereof. In the case of the tabular grains, at least 60% of total grain projected area is accounted for by tabular grains having a ratio of circular equivalent diameter to thickness of 1 to 20, more preferably not less than 1.2 and less than 10.0, and still more preferably not less than 1.5 and less than 8.0.

Monodisperse, regular crystal grain emulsions can be prepared according to the methods described in JP-A 59-177535, 60-138538, 59-52238, 60-143331, 60-35726, 60-258536 and 61-14636. Monodisperse, twin crystal grain emulsions can be prepared, for example; referring to the method described in JP-A 61-14636, in which spherical seed grains are allowed to grow. The grain growth is performed preferably by the double jet addition and iodide may be supplied in the form of silver iodide. In this case, the addition is conducted at a rate within the range of causing no nucleation and no Ostwald ripening, which broadens the grain size distribution. Thus, the addition rate is preferably 30 to 100% of the rate at which nucleation occurs. As another means for growing grains, silver halide grains are added to be used for grain growth through their dissolution and recrytallization. The growth of silver halide grains is performed preferably at a pAg of 5 to 11, at a temperature of 40 to 85° C. and a pH of 5 to 12.

Silver halide grain emulsions may be subjected to chemical sensitization according to conventional methods. Examples of chemical sensitization include chalcogen sensitization by the use of compounds containing chalcogen such as sulfur, selenium and tellurium; and noble metal sensitization by the use of noble metals such as gold. These are performed singly or in combination. Silver halide emulsion used-in this invention are preferably subjected to selenium sensitization using selenium sensitizers, as described in JP-A 9-265145. The addition amount of a selenium compound, depending on the kind thereof, the kind of a silver halide emulsion used and the conditions of chemical ripening, is preferably $10^{-8}$ to $10^{-3}$ mol, and more preferably $5\times10^{-8}$ to $1\times10^{-4}$ mol per mol of silver halide. The selenium compound is added by dissolving in water of an organic solvent such as methanol, ethanol, ethyl acetate, alone or in combination, or by mixing with an aqueous gelatin solution. Alternatively, as is disclosed in JP-A 4-140739, the it is added in the form of an emulsified dispersion of a mixture with an organic solvent-soluble polymer. The pAg (i.e., logarithmic reciprocal of the silver ion concentration) at the time of selenium sensitization is preferably 6.0 to 10.0, and more preferably 6.5 to 9.5. The pH is preferably 4 to 9, and more preferably 4.0 to 6.5. The temperature is preferably 40 to 90° C., and more preferably 45 to 85° C. The selenium sensitization is employed in combination with sulfur sensitization and gold sensitization alone or in combination thereof. Sulfur sensitizers include those described in U.S. Pat. Nos. 1,574,944, 2,410,689, 2,278,947, 2,728,6683,501, 313 and 3,656,955; West german Patent (OLS) 1,422,869; JP-A 55-45016,56-24937 and 5-165135. Of these, thiourea derivatives such as 1,3-dipheylthiourea, triethylthiourea and 1-ethyl-3-(2-thiazolyl)thiourea, rhodanine derivatives, thiocarbamates, polysulfide organic compounds and sulfur simple substance are preferred. The addition amount of a sulfur sensitizer, depending on the kind thereof, the kind of a silver halide emulsion used and the conditions of chemical ripening, is preferably $10^{-9}$ to $10^{-4}$ mol, and more preferably $10^{-8}$ to $1\times10^{-5}$ mol per mol of silver halide. Examples of gold sensitizers includechloroauric acid, gold thiosulfate, gold thicyanate, and gold complexes of thioureas, rhodanines or other compounds. The addition amount of a gold sensitizer, depending on the kind thereof, the kind of a silver halide emulsion used and the conditions of chemical ripening, is preferably $10^{-9}$ to $10^{-4}$ mol, and more preferably $5\times10^{-8}$ to $1\times10^{-5}$ mol per mol of silver halide. In addition, other chemical sensitizers to be used in combination include, for example, noble metal salts such as platinum, palladium and rhodium. The sensitization can also be conducted in the presence of silver halide solvents such as thiocyanates (e.g., ammonium thiocyanate, potassium thiocyanate) and tetra-substituted thiourea (e.g., tetramethylthiourea).

Silver halide grains used in this invention may be a surface latent image forming type or an internal latent image forming type. Further, an internally shallow latent image forming type grains are also usable, as described in JP-A 9-222684.

In this invention are employed silver halide emulsions which have been subjected to physical ripening, chemical sensitization and spectral sensitization. Additives used in such process are described in Research Disclosure (hereinafter, also denoted as RD) 17643 page 23, sect. III to page 24, sect. III-M; Rd18716 pages 648–649; and RD308119, page 996, sect. III-A to page 1000, sect. VI-M. Photographic additives usable in the invention are also described in RD17643, page 25, sect. VIII-A to page 27, sect. XIII; RD18716, pages 650–651; RD308119, page 1003, sect. VIII-A to page 1012, sect. XXI-E. Various types of couplers can be employed in color photographic materials, and examples thereof are described in RD17643 page 15, sect. VII-C to -G; and RD308119, page 1001, sect. VII-C to -G. Additives used in the invention can be incorporated through dispersion in such a manner as described in RD308119, page 1007 sect. XIV. Supports described in RD17643, page 28, sect. XVII, RD18716, page 647–648; and RD308119, page 1009, sect. XVII. In the photographic material, an auxiliary layer such as a filter layer or interlayer may be provide, as described in RD308119, page 1002, sect. VII-K. Photographic materials can have various layer arrangements such as convention layer order, reverse order and unit constitution, as described in RD308119, VII-K.

Silver halide emulsions used in this invention preferably include a heterocyclic compounds containing a mercapto group (or its precursor), as represented by general formula (I) described in JP-A 8-171157.

Photographic materials used in this invention may be provided with a magnetic recording layer to input various informations, including information regarding a photographic material such as the kind, manufacturing number, maker name, or emulsion number of the photographic material; information regarding camera-photographing such as the photographing date and time, aperture, exposure time, illumination condition, filters used, climate, picture-taking frame size, kind of camera or use of anamorphic lens; information necessary for printing such as print number, filter selection, customer's taste in color or trimming frame size; similar information obtained at the time of printing; and information regarding customers.

The magnetic recording layer is preferably provided on the opposite side to the photographic constituting layer. It is preferred to provide a sublayer, antistatic layer (conductive layer), magnetic recording layer and lubricating layer in this order from the support. Fine magnetic particles used in the magnetic recording layer include, for example, magnetic metal particles, magnetic iron oxide particles, magnetic Co-doped iron oxide particles, magnetic chromium dioxide particles, and magnetic barium ferrite particles. These magnetic particles can be prepared according to the method commonly known in the art.

The optical density of the magnetic recording layer is preferably as low as possible in view of influence on photographic images. Thus, it is preferably 1.5 or less, more preferably 0.2 or less, and still more preferably 0.1 or less. The optical density can be determined in a manner that 436 nm incident beam is allowed to enter vertically to the coated layer using Sakura Densitometer PDA-65 (available from Konica Corp.) and a blue light-transmitting filter and thereby light absorption caused by the coating layer is calculated.

The magnetizing amount of the magnetic recording layer is preferably not less than $3\times10^{-2}$ emu per $m^2$ of photographic material. The magnetizing amount can be determined in such a manner that after being saturated in the coating direction of the coat with an external magnetic field of 1,000 Oe, the external magnetic field is allowed to decreased and the magnetic flux density (residual magnetic density at the time when reached 0 is measured, which is converted to the volume pf a transparent magnetic layer contained per $m^2$ of the photographic material. In cases where the magnetizing amount is less than $3\times10^{-2}$ emu per $m^2$ of photographic material, input and output in magnetic recording are impaired.

The magnetic recording layer thickness is preferably 0.01 to 20 $\mu$m, more preferably 0.05 to 15 $\mu$m, and still more preferably 0.1 to 10 $\mu$m. Vinyl type resins, cellulose ester type resins, urethane type resins and polyester type resind are preferably employed as binder constituting the magnetic recording layer. It is also preferred to form binder with aqueous emulsion resin by aqueous coating, without using an organic solvent. Further, it is necessary to adjust physical property of the binder by hardening with a hardener, thermal hardening or electron beam hardening. Hardening by adding a polyisocyanate type hardener is specifically preferred. It is necessary to incorporate an abrasive into the magnetic recording layer to prevent clogging of a magnetic head. Non-magnetic metal oxide particles, specifically, fine alumina particles are preferably incorporated.

Support of the photographic material include polyester films such as polyethylene terephthalate (PET) and polyethylene naphthalate (PEN), cellulose triacetate film, cellulose diacetate film, polycarbonate film, polystyrene film and polyolefin film. In particular, a high moisture containing polyester support is superior in recovery of roll-set curl after processing even when the support is thinned, as described in JP-A 1-24444, 1-291248, 1-298350, 2-89045, 2-93641, 2-181749, 2-214852, and 2-291135. In the invention, Pet and PEN are preferably employed as a support. The thickness thereof is preferably between 50 and 100 $\mu$m, and more preferably 60 to 90 $\mu$m.

The photographic material according to the invention preferably has a conductive layer containing a metal oxide particles, such as ZnO, $V_2O_5$, $TiO_2$, $SnO_2$, $Al_2O_3$, $In_2O_3$, $SiO_2$, MgO, BaO or $MoO_3$. The metal oxide particles containing a small amount of oxygen deficiency or a hetero atom forming a donor to the metal oxide, which is high conductive, preferably employed. Specifically, the latter, which does not provide fog to the silver halide emulsion, is preferred.

Binders used in the conductive layer or a sublayer are the same as those used in the magnetic recording layer.

As a lubricating layer provided on the magnetic recording layer is coated a higher fatty acid ester, a higher fatty acid amide, polyorganosiloxane, a liquid paraffin or a wax.

In cases where the photographic material according to the invention is employed as a roll-formed color photographic camera material, not only miniaturization of a camera or patrone is achieved, but saving of natural resource is also possible. Since storage space for a negative film is small, the width of the film is 20 to 35 mm, and preferably 20 to 30 mm. If the photographing picture area is within the range of 300 to 700 $mm^2$, preferably, 400 to 600 $mm^2$, small format becomes possible without deteriorating image quality of a final photographic print, leading to further miniaturization of patrone and camera. The aspect ratio of a photographic image area is not limited and various types are employed, such as conventional 126 size of 1:1, a half-size of 1:1.4, 135 (standard) size of 1:1.5, hi-vision type of 1:1.8 and panorama type of 1:3.

When the photographic material according to the invention is used in a roll form, it is preferably contained in a cartridge. The most popular cartridge is a 135 format patrone. There are also employed cartridges proposed in Japanese Utility Model Application Opened to Public Inspection No. 58-67329 and 58-195236; JP-A 58-181035 and 58-182634; U.S. Pat. No. 4,221,479; JP-A 1-231045, 2-170156, 2-199451, 2-124564, 2-201441, 2-205843, 2-210346, 2-2114432-214853, 2-264248, 3-37645 and 3-37646; U.S. Pat. Nos. 4,846,418, 4,848,693 and 4,832,275. It is possible ally to "small-sized photographic roll film patrone and film camera" disclosed in JP-A 5-210201.

EXAMPLES

The present invention will be further described based on examples but embodiments of the invention are not limited to these.

Example 1

Preparation of Comparative Sample 101

On a triacetyl cellulose film support were formed the following layers containing composition as shown below to prepare a multi-layered color photographic material Sample 101. The addition amount of each compound was represented in term of $g/m^2$, provided that the amount of silver halide or colloidal silver was converted to the silver ($g/m^2$).

| | |
|---|---|
| 1st Layer (Anti-Halation Layer) | |
| Black colloidal silver | 0.24 |
| UV absorbent (UV-1) | 0.20 |
| High boiling solvent (OIL-2) | 0.20 |
| Gelatin | 1.50 |
| 2nd Layer (Intermediate Layer) | |
| Compound (SC-1) | 0.14 |
| High boiling solvent (OIL-2) | 0.17 |
| Gelatin | 0.70 |
| 3rd Layer (Low-speed Red-Sensitive Layer) | |
| Emulsion | 0.48 |
| Coupler (C-1) | 0.25 |
| High boiling solvent (OIL-2) | 0.10 |
| Gelatin | 0.65 |
| 4th Layer (Intermediate-speed Red-sensitive Layer) | |
| Emulsion | 0.46 |
| Coupler (C-1) | 0.35 |
| High boiling solvent (OIL-1) | 0.12 |
| Gelatin | 0.72 |
| 5th Layer (High-speed Red-Sensitive Layer) | |
| Emulsion | 0.55 |
| Coupler (C-1) | 0.70 |
| High boiling solvent (OIL-1) | 0.40 |
| Gelatin | 1.00 |

-continued

| | |
|---|---|
| 6th Layer (Intermediate Layer) | |
| Compound (SC-1) | 0.25 |
| High boiling solvent (OIL-2) | 0.30 |
| Gelatin | 1.20 |
| 7th Layer (Low-speed Green-Sensitive Layer) | |
| Emulsion | 0.48 |
| Magenta coupler (MM-1) | 0.15 |
| Magenta coupler (MM-2) | 0.04 |
| High boiling solvent (IL-2) | 0.04 |
| Gelatin | 0.60 |
| 8th Layer (Intermediate-speed Green-Sensitive Layer) | |
| Emulsion | 0.45 |
| Magenta coupler (MM-1) | 0.20 |
| Magenta coupler (MM-2) | 0.05 |
| High boiling solvent (IL-2) | 0.07 |
| Gelatin | 0.70 |
| 9th Layer (High-speed Green-Sensitive Layer) | |
| Emulsion | 0.61 |
| Magenta coupler (MM-1) | 0.36 |
| Magenta coupler (MM-2) | 0.07 |
| High boiling solvent (IL-2) | 0.20 |
| Gelatin | 1.00 |
| 10th Layer (Interlayer) | |
| Compound (SC-1) | 0.20 |
| High boiling solvent (OIL-2) | 0.24 |
| Gelatin | 0.80 |
| 11th Layer (Yellow Filter Layer) | |
| Yellow colloidal silver | 0.15 |
| Compound (SC-1) | 0.15 |
| High boiling solvent (OIL-2) | 0.17 |
| Gelatin | 0.90 |
| 12th Layer (Low-speed Blue-sensitive Layer) | |
| Emulsion | 0.20 |
| Coupler (Y-1) | 0.45 |
| High boiling solvent (OIL-2) | 0.05 |
| Gelatin | 0.65 |
| 13th Layer (Intermediate-sped Blue-sensitive Layer) | |
| Emulsion | 0.18 |
| Coupler (Y-1) | 0.45 |
| High boiling solvent (OIL-2) | 0.05 |
| Gelatin | 0.65 |
| 14th Layer (High-sped Blue-sensitive Layer) | |
| Emulsion | 0.72 |
| Coupler (Y-1) | 0.92 |
| High boiling solvent (OIL-2) | 0.10 |
| Gelatin | 1.25 |
| 15th Layer (First Protective Layer) | |
| Compound (SC-1) | 0.12 |
| High boiling solvent (OIL-2) | 0.15 |
| Gelatin | 0.60 |
| 16th Layer: Second protective Layer | |
| Light-insensitive silver halide emulsion having a mean grain size of 0.08 $\mu$m, containing 1 mol 5 iodide | 0.30 |
| UV absorvent (UV-1) | 0.25 |
| UV absorvent (UV-2) | 0.06 |
| High boiling solvent (OIL-2) | 0.20 |
| Gelatin | 1.40 |
| 17th Layer (Third Protective Layer) | |
| Polymer PM-1 | 0.12 |
| Polymer PM-2 | 0.03 |
| Lubricant (WAX-1) | 0.03 |
| Gelatin | 0.55 |

In addition to the above composition were added coating aids SU-1, SU-2 and SU-3; a dispersing aid SU-4; viscosity-adjusting agent V-1; stabilizers ST-1 and ST-2; fog restrainer AF-1 and AF-2 comprising two kinds polyvinyl pyrrolidone of weight-averaged molecular weights of 10,000 and 1.100,000; inhibitors AF-3, AF-4 and AF-5; hardener H-1 and H-2; and antiseptic Ase-1.

Chemical formulas of compounds used in the Samples described above are shown below.

SU-1: $C_8F_{17}SO_2N(C_3H_7)CH_2COOK$

SU-2: $C_8F_{17}SO_2NH(CH_2)_3N^+(CH_3)_3Br^-$

Su-3: Sodium di-(2-ethylhexyl) sulfosuccinate

SU-4: Tri-i-propylnaphthalenesulfonic acid sodium salt

ST-1: 4-hydroxy-6-methyl-1,3,3a,7-tetraazaindene

ST-2: Adenine

AF-3: 1-Phenyl-5-mercaptotetrazole

AF-4: 1-(4-Carboxyphenyl)-5-mercaptotetrazole

AF-5: 1-(3-Acetoamidophenyl)-5-mercaptotetrazole

H-1: $[CH_2{=}CHSO_2CH_2)_3CCH_2SO_2CH_2CH_2]_2NCH_2CH_2SO_3K$

H-2: 2,4-Dichloro-6-hydroxy-s-triazine sodium salt

OIL-1: Tricresyl phosphate

OIL-2: Di(2-ethylhexyl)phthalate

Coupler C-1

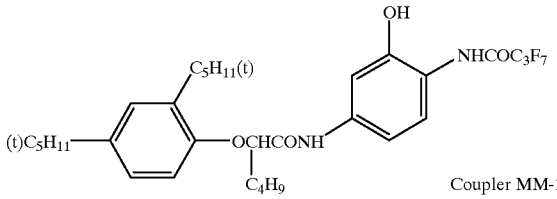

Coupler MM-1

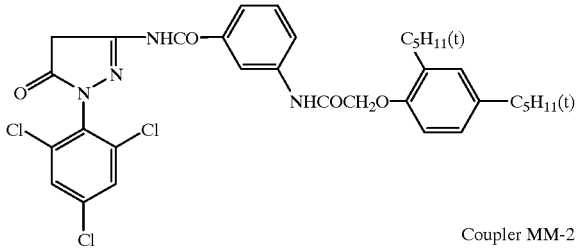

Coupler MM-2

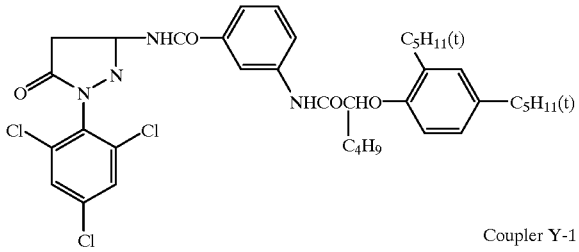

Coupler Y-1

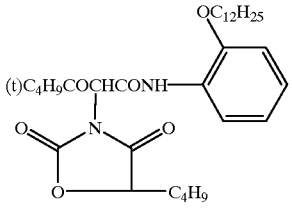

-continued

Compound SC-1

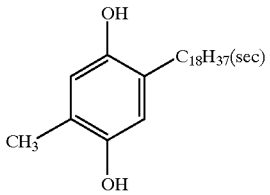

WAX-1

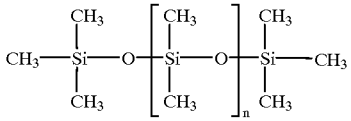

Mw = 3,000

PM-1

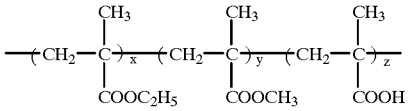

x:y:z =3:3:4

PM-2

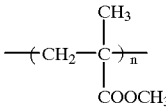

n: Degree of polymerization

UV-1

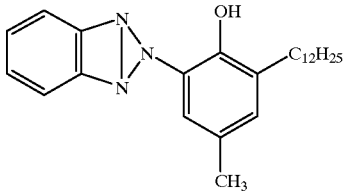

UV-2

$(C_6H_{13})_2N{-}CH{=}CH{-}CH{=}C(CN)_2$

V-1

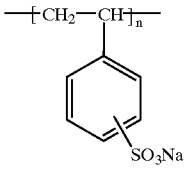

n: Degree of polymerization

Ase-1(Three component mixture as below)

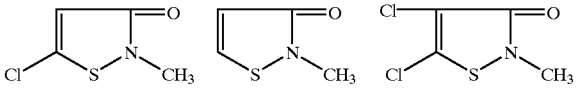

A:B:C=50:46:4 (Molar ratio)

S-1

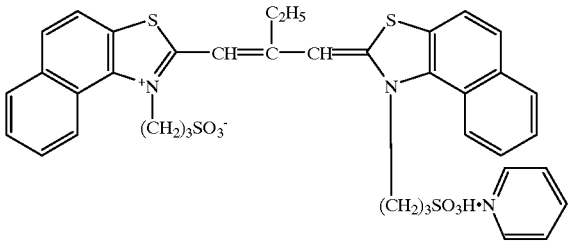

-continued

S-2

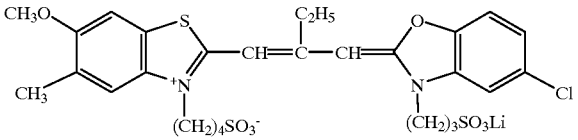

S-3

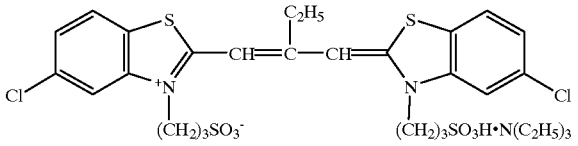

S-4

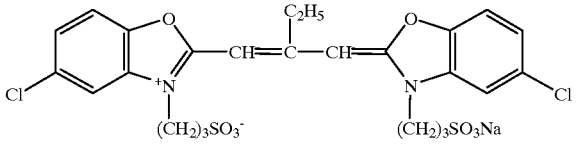

S-5

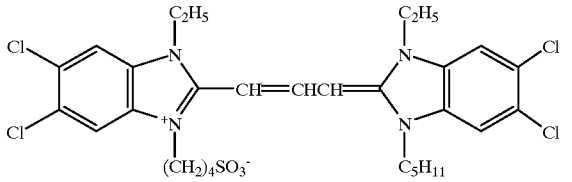

S-6

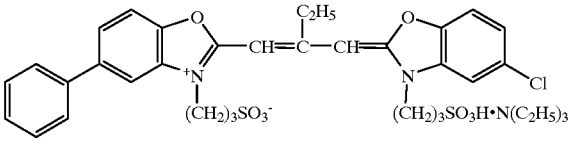

S-7

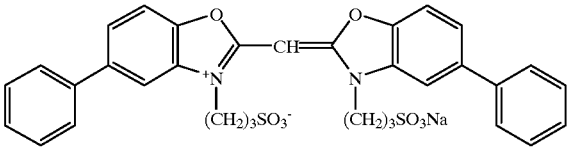

S-8

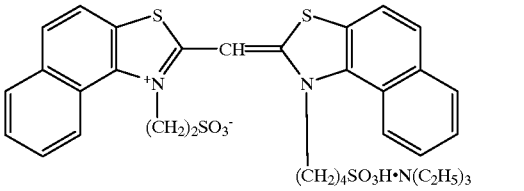

-continued

S-9

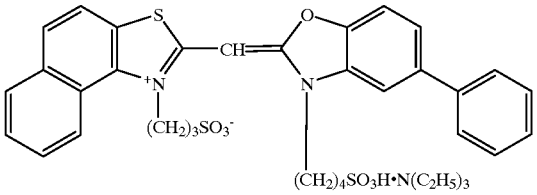

FF-1

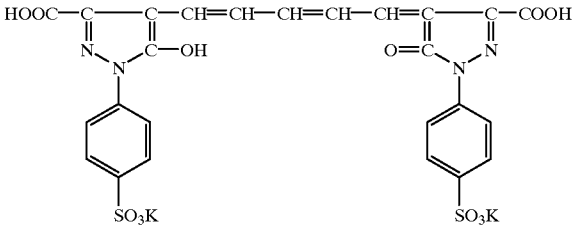

FF-2

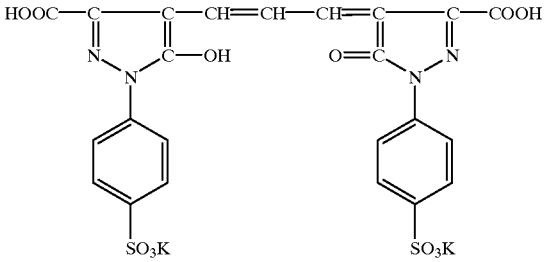

MF-1 Mixture (A:B = 4:6)

A

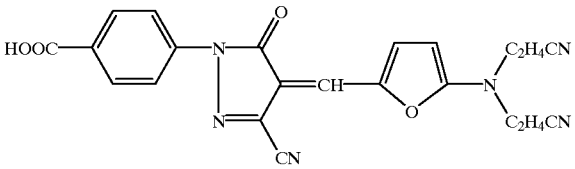

B

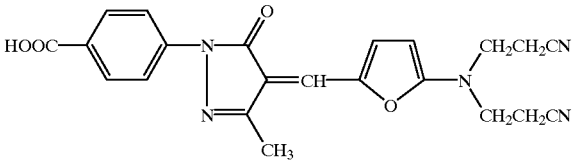

Light-sensitive silver halide emulsions used in Sample 101 are summarized in Table 1. Emulsion were each chemically sensitized together with sensitizing dyes (Dye s-1 to S-8), as shown in the Table.

TABLE 1

| Layer | Emulsion | Grain Feature | Silver Coverage ($g/m^2$) | Grain Size ($\mu m$) | Av. Aspect Ratio | VA-A (%) | Iodide (mol %) | Core/ Shell | (100) Ratio | VA-B (%) | Dislocation Line | Dye |
|---|---|---|---|---|---|---|---|---|---|---|---|---|
| Low-speed | A1 | Tetr. | 0.24 | 0.33 | 1.0 | 15 | 4.55 | 4/5 | 0.62 | 25 | No | S-1,S-2,S-3 |
| Red-sensitive Layer | B1 | Tetr. | 0.24 | 0.24 | 1.0 | 14 | 4.80 | 4/5 | 9.58 | 25 | No | S-1,S-2,S-3 |
| Intermediate-speed Red-sensitive Layer | C1 | Tetr. | 0.46 | 0.55 | 1.0 | 13 | 3.30 | 5/0 | 0.66 | 2 | No | S-1,S-2,S-3 |
| High-speed | D1 | Tabular | 0.20 | 0.88 | 6.1 | 24 | 2.70 | 4/1 | 0.02 | — | Yes | S-1,S-2,S-3 |

TABLE 1-continued

| Layer | Emulsion | Grain Feature | Silver Coverage (g/m$^2$) | Grain Size (μm) | Av. Aspect Ratio | VA-A (%) | Iodide (mol %) | Core/ Shell | (100) Ratio | VA-B (%) | Dislocation Line | Dye |
|---|---|---|---|---|---|---|---|---|---|---|---|---|
| Red-sensitive Layer | E1 | Tetr. | 0.35 | 0.64 | 1.0 | 9 | 2.80 | 0/4 | 0.61 | 18 | No | S-1,S-2,S-3 |
| Low-speed | F1 | Tetr. | 0.24 | 0.38 | 1.0 | 14 | 3.60 | 3/4 | 0.63 | 24 | No | S-4,S-5,S-6 |
| Green-sensitive Layer | G1 | Tetr. | 0.24 | 0.24 | 1.0 | 13 | 5.40 | 5/6 | 0.62 | 24 | No | S-4,S-5,S-6 |
| Intermediate-speed | H1 | Tetr. | 0.45 | 0.62 | 1.0 | 13 | 3.30 | 4/0 | 0.66 | 22 | No | S-4,S-5,S-6 |
| Green-sensitive Layer | | | | | | | | | | | | |
| High-speed | I1 | Tabular | 0.20 | 0.92 | 5.9 | 26 | 2.70 | 4/1 | 0.02 | — | Yes | S-4,S-5,S-6 |
| Green-sensitive Layer | J1 | Tetr. | 0.41 | 0.66 | 1.0 | 9 | 2.80 | 1/4 | 0.66 | 17 | No | S-4,S-5,S-6 |
| Low-speed | K1 | Tetr. | 0.10 | 0.38 | 1.0 | 11 | 4.05 | 2/5 | 0.70 | 22 | Yes | S-7,S-8 |
| Blue-sensitive Layer | L1 | Tetr. | 0.10 | 0.30 | 1.0 | 12 | 4.45 | 3/5 | 0.67 | 22 | No | S-7,S-8 |
| Intermediate-speed | M1 | Tetr. | 0.18 | 0.70 | 1.0 | 9 | 3.20 | 3/4 | 0.73 | 18 | Yes | S-7,S-8 |
| Blue-sensitive Layer | | | | | | | | | | | | |
| High-speed | N1 | Tabular | 0.52 | 1.20 | 4.9 | 18 | 3.05 | 5/1 | 0.02 | — | No | S-7,S-8 |
| Blue-sensitive Layer | O1 | Tetr. | 0.20 | 0.85 | 1.0 | 9 | 2.85 | 0/4 | 0.72 | 14 | Yes | S-7,S-8 |

Tetd: Tetradecahedral

In the Table, the grain size is represented by a circular equivalent diameter; "VA-A" represents a coefficient of variation of grain size; and VA-B represents a coefficient of variation of (100) face. "(100) Ratio" represents a ration of (100) face to total grain surface, which was determined by the method described in Japanese Patent Application No. 10-362801. Dislocation lines were observed to be formed in vicinity of the interface between core and shell of the grain.

preparation of Samples 102 through 106

Comparative Sample 102 and inventive Sample 103 through 106 were prepared in the same manner as Sample 101, except that silver halide emulsions used in light-sensitive layers were varied as shown in Table 2.

TABLE 2

| Sam-ple | Layer | Emul-sion | Grain Feature | Silver Coverage (g/m$^2$) | Grain Size (μm) | Av. Aspect Ratio | VA-A (%) | Iodide (mol %) | Core/ Shell | (100) Ratio | VA-B (%) | Dislocation Line | Dye |
|---|---|---|---|---|---|---|---|---|---|---|---|---|---|
| 102 | Low-speed | A1 | Tetr. | 0.18 | 0.33 | 1.0 | 15 | 4.55 | 4/5 | 0.62 | 25 | No | S-1,S-2,S-3 |
| | Red-sensitive Layer | B2 | Tetr. | 0.30 | 0.23 | 1.0 | 10 | 4.80 | 4/5 | 0.68 | 18 | Yes | S-1,S-2,S-3 |
| | Intermediate-speed | C2 | Tetr. | 0.46 | 0.53 | 1.0 | 13 | 3.30 | 5/0 | 0.66 | 23 | Yes | S-1,S-2,S-3 |
| | Red-sensitive Layer | | | | | | | | | | | | |
| | High-speed | D1 | Tabular | 0.20 | 0.88 | 6.1 | 24 | 2.70 | 4/1 | 0.02 | — | Yes | S-1,S-2,S-3 |
| | Red-sensitive Layer | E2 | Tetr. | 0.35 | 0.55 | 1.0 | 9 | 2.80 | 0/4 | 0.70 | 15 | Yes | S-1,S-2,S-3 |
| | Low-speed | F2 | Tetr. | 0.12 | 0.38 | 1.0 | 12 | 3.60 | 3/4 | 0.68 | 22 | Yes | S-4,S-5,S-6 |
| | Green-sensitive Layer | G2 | Tetr. | 0.36 | 0.24 | 1.0 | 10 | 5.40 | 5/6 | 0.71 | 18 | Yes | S-4,S-5,S-6 |
| 102 | Intermediate-speed | H2 | Tetr. | 0.45 | 0.55 | 1.0 | 9 | 3.30 | 4/0 | 0.66 | 22 | Yes | S-4,S-5,S-6 |
| | Green-sensitive Layer | | | | | | | | | | | | |
| | High-speed | I1 | Tabular | 0.20 | 0.92 | 5.9 | 26 | 2.70 | 4/1 | 0.02 | — | Yes | S-4,S-5,S-6 |
| | Green-sensitive Layer | J2 | Tetr. | 0.41 | 0.58 | 1.0 | 9 | 2.80 | 1/4 | 0.70 | 17 | Yes | S-4,S-5,S-6 |
| 103 | Low-speed | A2 | Tetr. | 0.18 | 0.30 | 1.0 | 8 | 4.55 | 4/5 | 0.73 | 17 | Yes | S-1,S-2,S-3 |
| | Red-sensitive Layer | B2 | Tetr. | 0.30 | 0.23 | 1.0 | 10 | 4.80 | 4/5 | 0.68 | 18 | Yes | S-1,S-2,S-3 |
| 104 | Low-speed | A2 | Tetr. | 0.10 | 0.30 | 1.0 | 8 | 4.55 | 4/5 | 0.73 | 17 | Yes | S-1,S-2,S-3 |
| | Red-sensitive Layer | B3 | Tetr. | 0.38 | 0.22 | 1.0 | 8 | 4.40 | 4/5 | 0.75 | 14 | Yes | S-1,S-2,S-3 |
| 104 | Intermediate-speed | C2 | Tetr. | 0.46 | 0.53 | 1.0 | 13 | 3.30 | 5/0 | 0.66 | 23 | Yes | S-1,S-2,S-3 |
| | Red-sensitive Layer | | | | | | | | | | | | |
| 105 | Low-speed | F3 | Tetr. | 0.36 | 0.33 | 1.0 | 12 | 3.60 | 3/4 | 0.70 | 22 | Yes | S-4,S-5,S-6 |
| | Green-sensitive Layer | G3 | Tetr. | 0.12 | 0.22 | 1.0 | 10 | 5.00 | 5/6 | 0.74 | 18 | Yes | S-4,S-5,S-6 |
| 106 | Low-speed | A2 | Tetr. | 0.10 | 0.30 | 1.0 | 8 | 4.55 | 4/5 | 0.73 | 17 | Yes | S-1,S-2,S-3 |
| | Red-sensitive Layer | B3 | Tetr. | 0.38 | 0.22 | 1.0 | 8 | 4.40 | 4/5 | 0.75 | 14 | Yes | S-1,S-2,S-3 |
| | Intermediate-speed | C2 | Tetr. | 0.46 | 0.53 | 1.0 | 13 | 3.30 | 5/0 | 0.66 | 23 | Yes | S-1,S-2,S-3 |
| | Red-sensitive Layer | | | | | | | | | | | | |
| 106 | Low-speed | F3 | Tetr. | 0.36 | 0.33 | 1.0 | 12 | 3.60 | 3/4 | 0.70 | 22 | Yes | S-4,S-5,S-6 |
| | Green-sensitive Layer | G3 | Tetr. | 0.12 | 0.22 | 1.0 | 10 | 5.00 | 5/6 | 0.74 | 18 | Yes | S-4,S-5,S-6 |
| 107 | Low-speed | A2 | Tetr. | 0.15 | 0.30 | 1.0 | 8 | 4.55 | 4/5 | 0.73 | 17 | Yes | S-1,S-2,S-3 |
| | Red-sensitive Layer | B3 | Tetr. | 0.33 | 0.20 | 1.0 | 8 | 4.40 | 4/5 | 0.75 | 14 | Yes | S-1,S-2,S-3 |
| | Intermediate-speed | C2 | Tetr. | 0.46 | 0.53 | 1.0 | 13 | 3.30 | 5/0 | 0.66 | 23 | Yes | S-1,S-2,S-3 |
| | Red-sensitive Layer | | | | | | | | | | | | |
| | Low-speed | F3 | Tetr. | 0.36 | 0.33 | 1.0 | 12 | 3.60 | 3/4 | 0.70 | 22 | Yes | S-4,S-5,S-6 |
| | Green-sensitive Layer | G3 | Tetr. | 0.12 | 0.22 | 1.0 | 10 | 5.00 | 5/6 | 0.74 | 18 | Yes | S-4,S-5,S-6 |

Tetd: Tetradecahedral

In the Table, the grain size is represented by a circular equivalent diameter; "VA-A" represents a coefficient of variation of grain size; and VA-B represents a coefficient of variation of (100) Ratio. "(100) Ratio" represents a ratio of (100) face to the total grain surface, i.e., the proportion occupied by (100) face among the total grain surface, which was determined by the method described in Japanese Patent Application No. 10-362801. Thus, a metal is allowed to vapor-deposit over each of silver halide grains from the oblique direction (shadowing treatment) and observed with SEM (Scanning Electron Microscope). The observed images are further subjected to image processing to determine the (100) ratio. Dislocation lines were observed to be formed in vicinity of the interface between core and shell of the grain.

Evaluation of Samples

Photographic material samples were each exposed to white light through an optical wedge and processed according to the process described later.

In each of processed samples, the RMS granularity at densities of 1.6 and 0.8 were measured with respect to magenta and cyan densities, according to the afore-described method. At the same time, there were also determined the RMS value ratio of cyan to magenta at a density of 0.8, i.e., RMS(R)÷RMS(G), and the ratio of RMS value at a density of 0.8 at a density of 1.6, i.e., RMS(0.8)÷RMS (1.6). results thereof are shown in Table 3.

Further, photographic material samples were each cut to the 135 size standard, put into a patrone, and loaded into a camera (Konica Hexer, produced by Konica Corp.). Then, perspective views of a mountain, the sea, a park, a high-rise building and an airport were each taken with the sky for a background. The weather at the time of photographing was fine and slightly misty at the park and airport. Processed samples were each printed onto Konica Chrome Type 81 to obtain enlarged prints of 10×12 inch. The thus obtained 30 prints of five scenes of Samples 101 through 106 were visually evaluated by 10 men and 10 women with respect to texter of graininess of the sky, based five grades. Evaluation on results are represented by average value thereof, as in Table 4.

"3" is the excellent level and "3" is the average level) and average value thereof are shown in Table 4.

In summary, the sky of Sample 101 was specifically misty and its granularity was marked, resulting in impaired texture. Sample 102 also was not a satisfactory level though superior in graininess to Sample 101. On the contrary, Samples 103 to 104 were each improved in texture and satisfactory levels. It was an unexpected result that Samples 103, 104, 106 and 107 exhibited markedly superior texture irrespective of the fact that they included a portion inferior in RMS granularity to Sample 102. Specifically, Samples 104 and 107 obtained higher points in all regions regardless of the density of the sky.

Using Samples 101 through 106, portraits of women as main object were taken and the subjective evaluation thereof was made with respect to skin tone reproduction according to the similar manner as described earlier. As a result, it was proved that Samples 102 through 106 exhibited superior results to a similar extent, as compared to Sample 101.

TABLE 3

| | RMS(G) | | RMS(R) | | A | B | |
|---|---|---|---|---|---|---|---|
| | | | | | D = 0.8 | Green | Red |
| Sample | D = 1.6 | D = 0.8 | D = 1.6 | D = 0.8 | (%) | (%) | (%) | Remark |
| 101 | 22 | 12 | 20 | 14 | 1.17 | 0.55 | 0.70 | Comp. |
| 102 | 20 | 10.5 | 16 | 12 | 1.14 | 0.53 | 0.75 | Comp. |
| 103 | 22 | 12 | 20 | 10.5 | 0.88 | 0.55 | 0.53 | Inv. |
| 104 | 22 | 12 | 20 | 9 | 0.75 | 0.55 | 0.45 | Inv. |
| 105 | 22 | 10.5 | 20 | 14 | 1.47 | 0.48 | 0.70 | Comp. |
| 106 | 22 | 10.5 | 20 | 9 | 0.85 | 0.48 | 0.45 | Inv. |
| 107 | 22 | 10.5 | 20 | 8 | 0.76 | 0.48 | 0.40 | Inv. |

TABLE 4

| Sample | Evaluation Point | Remark |
|---|---|---|
| 101 | 2.6 | Comp. |
| 102 | 3.3 | Comp. |
| 103 | 4.1 | Inv. |
| 104 | 4.6 | Inv. |
| 105 | 3.9 | Comp. |
| 106 | 4.5 | Inv. |
| 107 | 4.8 | Inv. |

In the Tables, A represents a ratio of RMS value at cyan density of 0.8 to RMS value at a magenta density of 0.8; and B represents a ratio of RMS value at a density of 0.8 to RMS value at a density of 1.6, that is, A: RMS(R)÷RMS (G) at a density of 0.8 (i.e., D=0.8)

B: RMS(0.8)÷RMS(1.6).

Evaluation was done by 20 persons with respect to 5 scenes, based on five grades (in which "1" is the poor level,

| Processing | | |
|---|---|---|
| Step | Temperature | Time |
| First developing | 6 min. | 38° C. |
| Washing | 2 min. | 38° C. |
| Reversal | 2 min. | 38° C. |
| Color developing | 6 min. | 38° C. |
| Adjusting | 2 min. | 38° C. |
| Bleaching | 6 min. | 38° C. |

-continued

| Processing | | |
|---|---|---|
| Step | Temperature | Time |
| Fixing | 4 min. | 38° C. |
| Washing | 4 min. | 38° C. |
| Stabilizing | 1 min. | Ord. temp. |
| Drying | | |

Processing solutions used in the above steps are as follows.

| First Developer Solution | |
|---|---|
| Sodium tetrapolyphosphate | 2 g |
| Sodium sulfite | 20 g |

-continued

| | |
|---|---|
| Hdroquinone monosulfate | 30 g |
| Sodium carbonate (monohydrate) | 30 g |
| 1-Phenyl-4-methyl-4-hydroxymethyl-3-pyrazolidone | 2 g |
| Potassium bromide | 2.5 g |
| Potassium thiocyanate | 1.2 g |
| Potassium iodide (0.1% solution) | 2 ml |
| Water was added to make 1000 ml (and pH of 9.60) | |
| Reversal Solution | |
| Hexasodium nitrilotrimethylene phosphonate | 3 g |
| Stannous chloride (dihydrate) | 1 g |
| p-Aminophenol | 0.1 g |
| Sodium hydroxide | 8 g |
| Glacial acetic acid | 15 ml |
| Water to make 1000 ml (pH of 5.75) | |
| Color Developer Solution | |
| Sodium tetrapolyphosphate | 3 g |
| Sodium sulfite | 7 g |
| Sodium tertiary phosphate (dihydrate) | 36 g |
| Potassium bromide | 1 g |
| Potassium iodide (0.1% solution) | 90 ml |
| Sodium hydroxide | 3 g |
| Citrazinic acid | 1.5 g |
| N-ethyl-N-(β-methanesulfonamidoethyl)-3-methyl-4-aminoaniline sulfate | 11 g |
| 2,2-Ethylendithioethanol | 1 g |
| Water to make 1000 ml (pH of 11.70) | |
| Conditioner | |
| Sodium sulfite | 12 g |
| Sodium ethylenediaminetertaacetate (dihydrate) | 8 g |
| Thioglycerin | 0.4 g |
| Glacial acetic acid | 3 ml |
| Water to make 1000 ml (pH of 6.15) | |
| Bleaching Solution | |
| Sodium ethylenediaminetertaacetate (dihydrate) | 2 g |
| Ammonium ferric ethylenediaminetertaacetate (dihydrate) | 120 g |
| Potassium bromide | 100 g |
| Water to make 1000 ml (pH of 5.56) | |
| Fixer Solution | |
| Ammonium thiosulfate | 80 g |
| Sodium sulfite | 5 g |
| Sodium bisulfite | 5 g |
| Water to make 1000 ml (pH o 6.60) | |
| Stabilizer Solution | |
| Formalin (37 wt %) | 5 ml |
| KONIDUCKS (available from Konica Corp.) | 5 ml |
| Water to make 1000 ml (pH of 7.00). | |

Example 2

Photographic material Sample 201 was prepared in the same manner as Sample 103 of Example 1, except that the 16th layer (second protective layer) was varied as follows:

16th Layer: Second protective Layer

| | |
|---|---|
| Light-insensitive silver halide emulsion having a mean grain size of 0.08 μm, containing 1 mol 5 iodide | 0.30 |
| Yellow colloidal silver | 0.008 |
| Dye (FF-1) | 0.002 |
| Dye (FF-2) | 0.002 |
| UV absorvent (UV-1) | 0.25 |
| UV absorvent (UV-2) | 0.06 |
| High boiling solvent (OIL-2) | 0.20 |
| Gelatin | 1.40 |

Preparation of Samples 202 Through 206

Comparative sample 202 was prepared in the same manner as Sample 201, except that amounts of dyes FF-1 and FF-2 used in the $16^{th}$ layer were each increased to 0.004 g. Inventive Sample 203 through 206 were also prepared in the same manner as sample 201, except that the amounts of the dyes used in the 16th layer were varied as shown in Table 5 and the emulsions used in the photosensitive layers were varied as shown in Table 6 .

TABLE 5

| Sample | FF-1 | FF-2 | MF-1 |
|---|---|---|---|
| 201 | 0.002 | 0.002 | — |
| 202 | 0.004 | 0.004 | — |
| 203 | 0.008 | 0.002 | — |
| 204 | 0.010 | 0.002 | — |
| 205 | 0.008 | 0.003 | — |
| 206 | 0.006 | 0.003 | 0.025 |

TABLE 6

| Sample | Layer | Emulsion | Grain Feature | Silver Coverage (g/m²) | Grain Size (μm) | Av. Aspect Ratio | VA-A (%) | Iodide (mol %) | Core/Shell | (100) Ratio | VA-B (%) | Dislocation Line | Dye |
|---|---|---|---|---|---|---|---|---|---|---|---|---|---|
| 202 | The same as Sample 201 | | | | | | | | | | | | |
| 203 | Low-speed | A2 | Tetr. | 0.18 | 0.30 | 1.0 | 8 | 4.55 | 4/5 | 0.73 | 17 | Yes | S-1,S-2,S-3 |
| | Red-sensitive Layer | B2 | Tetr. | 0.30 | 0.23 | 1.0 | 10 | 4.80 | 4/5 | 0.68 | 18 | Yes | S-1,S-2,S-3 |
| 204 | Low-speed | A2 | Tetr. | 0.18 | 0.30 | 1.0 | 8 | 4.55 | 4/5 | 0.73 | 17 | Yes | S-1,S-2,S-3 |
| | Red-sensitive Layer | B2 | Tetr. | 0.30 | 0.23 | 1.0 | 10 | 4.80 | 4/5 | 0.68 | 18 | Yes | S-1,S-2,S-3 |
| | Intermediate-speed | C2 | Tetr. | 0.26 | 0.53 | 1.0 | 13 | 3.30 | 5/0 | 0.66 | 23 | Yes | S-1,S-2,S-3 |
| | Red-sensitive Layer | E3 | Tetr. | 0.20 | 0.55 | 1.0 | 9 | 2.80 | 0/4 | 0.52 | 21 | Yes | S-1,S-2,S-3 |
| 205 | Low-speed | A2 | Tetr. | 0.18 | 0.30 | 1.0 | 8 | 4.55 | 4/5 | 0.73 | 17 | Yes | S-1,S-2,S-3 |
| | Red-sensitive Layer | B2 | Tetr. | 0.30 | 0.23 | 1.0 | 10 | 4.80 | 4/5 | 0.68 | 18 | Yes | S-1,S-2,S-3 |
| | High-speed | D2 | Tabular | 0.45 | 0.90 | 6.8 | 24 | 2.70 | 4/1 | 0.02 | — | Yes | S-1,S-2,S-3 |
| | Red-sensitive Layer | E3 | Tetr. | 0.10 | 0.55 | 1.0 | 9 | 2.80 | 0/4 | 0.52 | 21 | Yes | S-1,S-2,S-3 |

TABLE 6-continued

| Sample | Layer | Emulsion | Grain Feature | Silver Coverage ($g/m^2$) | Grain Size ($\mu m$) | Av. Aspect Ratio | VA-A (%) | Iodide (mol %) | Core/Shell | (100) Ratio | VA-B (%) | Dislocation Line | Dye |
|---|---|---|---|---|---|---|---|---|---|---|---|---|---|
| 206 | Low-speed | A2 | Tetr. | 0.18 | 0.30 | 1.0 | 8 | 4.55 | 4/5 | 0.73 | 17 | Yes | S-1,S-2,S-3 |
| | Red-sensitive Layer | B2 | Tetr. | 0.30 | 0.23 | 1.0 | 10 | 4.80 | 4/5 | 0.68 | 18 | Yes | S-1,S-2,S-3 |
| | Intermediate-speed | C2 | Tetr. | 0.26 | 0.53 | 1.0 | 13 | 3.30 | 5/0 | 0.66 | 23 | Yes | S-1,S-2,S-3 |
| | Red-sensitive Layer | E3 | Tetr. | 0.20 | 0.55 | 1.0 | 9 | 2.80 | 0/4 | 0.52 | 21 | Yes | S-1,S-2,S-3 |
| | High-speed | D2 | Tabular | 0.45 | 0.90 | 6.8 | 24 | 2.70 | 4/1 | 0.02 | — | Yes | S-1,S-2,S-3 |
| | Red-sensitive Layer | E3 | Tetr. | 0.10 | 0.55 | 1.0 | 9 | 2.80 | 0/4 | 0.52 | 21 | Yes | S-1,S-2,S-3 |
| | High-speed | I1 | Tabular | 0.40 | 0.92 | 5.9 | 26 | 2.70 | 4/1 | 0.02 | — | Yes | S-4,S-5,S-6 |
| | Green-sensitive Layer | J2 | Tetr. | 0.21 | 0.58 | 1.0 | 9 | 2.80 | 1/4 | 0.70 | 17 | Yes | S-4,S-5,S-6 |

Tetd: Tetradecahedral

In Table 5, the amount of the dye is represented in g/m2. Dyes FF-1 and FF-2 were incorporated into the 16th layer and dye MF-1 was incorporated in the 6th layer. MF-1 was dispersed in the form of a solid particle dispersion according to the method described in Japanese Patent Application No. 10-237120.

In the Table, the grain size is represented by a circular equivalent diameter; "VA-A" represents a coefficient of variation of grain size; and VA-B represents a coefficient of variation of (100) face. "(100) Ratio" represents a ration of (100) face to total grain surface, which was determined by the method described in Japanese Patent Application No. 10-362801. Formation of dislocation lines were observed in vicinity of the interface between core and shell of the grain.

Evaluation of Samples

The thus prepared Samples 201 through 206 were each subjected to low density pattern exposure and high density pattern exposure according to the manner as afore-described and the MTF value at 20 lines/20 mm was determined with respect to Red and Green [denoted as MTF(R) and MTF (G)]. At the same time, there were determined a ratio of the MTF value of Red obtained from the low density pattern to that of Green obtained from the low density pattern (denoted as "C" in the Table) and a ratio of the MTF value at the high density pattern (H.D.) to that at the low density pattern (L.D.), i.e., MTF(H.D.)÷MTF(L.D.) , which is designated as "D" in the Table. Results thereof are shown in Table 7.

Further, photographic material samples were each cut to Brownie size (i.e., 120 film size) and loaded into a camera (RZ67 Profesional, available from Mamiya OP Co. Ltd). Then, five views of a mountain, woods, valley, tropical plant garden and Japanese horseradish garden, each of which was hardly exposed to sunlight were photographed. In this case, the main photographic objects were clear ones such as branches, barks, rocks, red flowers and leaves within a distance of 5 m or so, instead of distant panoramas. The thus picture-taken samples were processed similarly to Example 1. The thus obtained print samples of five scenes of Samples 201 through 206 were visually evaluated by 10 men and 10 women with respect to texture of sharpness and perception of depth, based on five grades. Evaluation results are represented by average value thereof, as shown in Table 8.

TABLE 7

| | MTF(G) | | MTF(R) | | A D = 0.8 | | D | |
|---|---|---|---|---|---|---|---|---|
| Sample | H.D. | L.D. | H.D. | L.D. | (%) | C | Green | Red |
| 201 | 60 | 58 | 44 | 39 | 0.88 | 0.67 | 1.03 | 1.13 |
| 202 | 62 | 60 | 46 | 42 | 0.88 | 0.70 | 1.03 | 1.10 |
| 203 | 60 | 58 | 53 | 47 | 0.85 | 0.81 | 1.03 | 1.13 |
| 204 | 60 | 58 | 57 | 55 | 0.82 | 0.96 | 1.03 | 1.08 |
| 205 | 62 | 57 | 57 | 47 | 0.80 | 0.82 | 1.13 | 1.21 |
| 206 | 74 | 60 | 46 | 50 | 0.79 | 0.83 | 1.23 | 0.92 |

TABLE 8

| Sample | Evaluation Point |
|---|---|
| 201 | 3.8 |
| 202 | 4.0 |
| 203 | 4.4 |
| 204 | 4.5 |
| 205 | 4.6 |
| 206 | 4.6 |

In the Tables, C represents a ratio of the MTF value at a low cyan density to the MTF value at a low magenta density; and D represents a ratio of the MTF value at a high density to the MTF value at a low density, that is, A: MTF(R)÷.MTF(G) at a low density (L.D.)

B: MTF(H.D.)÷RMS(L.D.).

Evaluation was done by 20 persons with respect to 5 scene, based on five grades (in which "1" is the poor level, excellent level and "3" is the average level) and the averaged values thereof are shown in Table 8.

Sample 202 exhibited enhanced MTF values in the overall areas and superior results of visual judgment compared to Sample 201, but did not reach satisfactory levels. Samples 203 through 206, although some of them were inferior in MTF value to Sample 202, led to unexpectedly superior results in visual judgment with respect to high density scene in which photographic objects not directly exposed to sunlight were photographed. Specifically, Sample 204 was superior in perception of depth of red flowers and green leaves of tropical plants and Samples 205 and 206 were superior in sharpness representation of tree branches and rocks.

Example 3

Preparation of Sample 301

Comparative Sample 301 was prepared in the same manner as Sample 104, except that the silver halide emulsion used in the 4th layer (low-speed red-sensitive layer) was varied as shown in Table 10.

Preparation of Samples 302 through 306 were each prepared in the same manner as Sample 301, except that silver emulsion used in light-sensitive layers were varied as shown in Table 10. Further, in Sample 307, dye MF-1 described in Japanese Patent Application No. 10-237120 was used in the 6th layer (interlayer), in the form of a solid particle dispersion.

Evaluation of Samples

There were determined the difference in sensitivity at a density of 1.0, SG and SR , the point-gamma ($\gamma^R$) of the red-sensitive layer at a density of 0.7 or 2.0 obtained when exposed to red light, and the point-gamma ($\gamma^G$) of the green-sensitive layer at a density of 0.7 or 2.0 obtained when exposed to green light. At the same time, the difference SR-SG and values of $\gamma^1$ and $\gamma^2$ were also determined. Results thereof are shown in Table 10.

TABLE 9

| Sample | Layer | Emulsion | Grain Feature | Silver Coverage (g/m$^2$) | Grain Size ($\mu$m) | Av. Aspect Ratio | VA-A (%) | Iodide (mol %) | Core/ Shell | (100) Ratio | VA-B (%) | Dislocation Line | Dye |
|---|---|---|---|---|---|---|---|---|---|---|---|---|---|
| 301 | Low-speed | A2 | Tetr. | 0.18 | 0.30 | 1.0 | 8 | 4.55 | 4/5 | 0.73 | 17 | Yes | S-1,S-2,S-3 |
| | Red-sensitive Layer | B2 | Tetr. | 0.30 | 0.23 | 1.0 | 10 | 4.80 | 4/5 | 0.68 | 18 | Yes | S-1,S-2,S-3 |
| 302 | Intermediate-speed | M1 | Tetr. | 0.10 | 0.70 | 1.0 | 9 | 3.20 | 3/4 | 0.73 | 18 | Yes | S-7,S-8 |
| | Blue-sensitive Layer | O2 | Tetr. | 0.15 | 0.85 | 1.0 | 9 | 3.25 | 0/4 | 0.72 | 18 | Yes | S-7,S-8 |
| | High-speed | N2 | Tabular | 0.52 | 1.15 | 4.9 | 18 | 4.20 | 6/1 | 0.02 | — | No | S-7,S-8 |
| | Blue-sensitive Layer | O2 | Tetr. | 0.20 | 0.85 | 1.0 | 9 | 3.25 | 0/4 | 0.72 | 18 | Yes | S-7,S-8 |
| 303 | High-speed | D2 | Tabular | 0.30 | 0.90 | 6.8 | 24 | 2.70 | 4/1 | 0.02 | — | Yes | S-1,S-2,S-3 |
| | Red-sensitive Layer | E2 | Tetr. | 0.25 | 0.55 | 1.0 | 9 | 2.80 | 0/4 | 0.70 | 15 | Yes | S-1,S-2,S-3 |
| 303 | Intermediate-speed | H2 | Tetr. | 0.25 | 0.55 | 1.0 | 9 | 3.30 | 4/0 | 0.66 | 22 | Yes | S-4,S-5,S-6 |
| | Green-sensitive Layer | H3 | Tetr. | 0.20 | 0.40 | 1.0 | 11 | 3.00 | 0/5 | 0.62 | 22 | Yes | S-4,S-5,S-6 |
| | High-speed | I2 | Tabular | 0.42 | 0.92 | 7.0 | 27 | 2.50 | 4/1 | 0.02 | — | Yes | S-4,S-5,S-6 |
| | Green-sensitive Layer | J2 | Tetr. | 0.20 | 0.58 | 1.0 | 9 | 2.80 | 1/4 | 0.70 | 17 | Yes | S-4,S-5,S-6 |
| 304 | High-speed | D2 | Tabular | 0.30 | 0.90 | 6.8 | 24 | 2.70 | 4/1 | 0.02 | — | Yes | S-1,S-2,S-3 |
| | Red-sensitive Layer | E2 | Tetr. | 0.25 | 0.55 | 1.0 | 9 | 2.80 | 0/4 | 0.70 | 15 | Yes | S-1,S-2,S-3 |
| | Low-speed | F2 | Tetr. | 0.12 | 0.38 | 1.0 | 12 | 3.60 | 3/4 | 0.68 | 22 | Yes | S-4,S-5,S-6 |
| | Green-sensitive Layer | G2 | Tetr. | 0.36 | 0.24 | 1.0 | 10 | 5.40 | 5/6 | 0.71 | 18 | Yes | S-4,S-5,S-6 |
| 304 | Intermediate-speed | H2 | Tetr. | 0.15 | 0.55 | 1.0 | 9 | 3.30 | 4/0 | 0.66 | 22 | Yes | S-4,S-5,S-6 |
| | Green-sensitive Layer | H3 | Tetr. | 0.20 | 0.40 | 1.0 | 11 | 3.00 | 0/5 | 0.62 | 22 | Yes | S-4,S-5,S-6 |
| | | J3 | Tetr. | 0.20 | 0.58 | 1.0 | 9 | 2.80 | 1/4 | 0.20 | 30 | Yes | S-4,S-5,S-6 |
| | High-speed | I2 | Tabular | 0.42 | 0.92 | 7.0 | 27 | 2.50 | 4/1 | 0.02 | — | Yes | S-4,S-5,S-6 |
| | Green-sensitive Layer | J2 | Tetr. | 0.20 | 0.58 | 1.0 | 9 | 2.80 | 1/4 | 0.70 | 17 | Yes | S-4,S-5,S-6 |
| 305 | Intermediate-speed | C2 | Tetr. | 0.26 | 0.53 | 1.0 | 13 | 3.30 | 5/0 | 0.66 | 23 | Yes | S-2,S-3 |
| | Red-sensitive Layer | C3 | Tetr. | 0.20 | 0.38 | 1.0 | 13 | 3.30 | 5/0 | 0.64 | 20 | Yes | S-2,S-3 |
| 305 | High-speed | D2 | Tabular | 0.30 | 0.90 | 6.8 | 24 | 2.70 | 4/1 | 0.02 | — | Yes | S-1,S-2,S-3 |
| | Red sensitive Layer | E2 | Tetr. | 0.25 | 0.55 | 1.0 | 9 | 2.80 | 0/4 | 0.70 | 15 | Yes | S-1,S-2,S-3 |
| | Intermediate-speed | H2 | Tetr. | 0.25 | 0.55 | 1.0 | 9 | 3.30 | 4/0 | 0.66 | 22 | Yes | S-4,S-5,S-6 |
| | Green-sensitive Layer | H3 | Tetr. | 0.20 | 0.40 | 1.0 | 11 | 3.00 | 0/5 | 0.62 | 22 | Yes | S-4,S-5,S-6 |
| | | J3 | Tetr. | 0.20 | 0.58 | 1.0 | 9 | 2.80 | 1/4 | 0.20 | 30 | Yes | S-4,S-5,S-6 |
| | High-speed | I2 | Tabular | 0.42 | 0.92 | 7.0 | 27 | 2.50 | 4/1 | 0.02 | — | Yes | S-4,S-5,S-6 |
| | Green-sensitive Layer | J2 | Tetr. | 0.20 | 0.58 | 1.0 | 9 | 2.80 | 1/4 | 0.70 | 17 | Yes | S-4,S-5,S-6 |
| | Low-speed | K2 | Tetr. | 0.15 | 0.38 | 1.0 | 11 | 2.85 | 0/5 | 0.74 | 15 | Yes | S-7,S-8 |
| | Blue-sensitive Layer | L1 | Tetr. | 0.10 | 0.30 | 1.0 | 12 | 4.45 | 3/5 | 0.67 | 22 | No | S-7,S-8 |
| 306 | Intermediate-speed | C2 | Tetr. | 0.26 | 0.53 | 1.0 | 13 | 3.30 | 5/0 | 0.66 | 23 | Yes | S-2,S-3 |
| | Red-sensitive Layer | C3 | Tetr. | 0.20 | 0.38 | 1.0 | 13 | 3.30 | 5/0 | 0.64 | 20 | Yes | S-2,S-3 |
| | High-speed | D2 | Tabular | 0.30 | 0.90 | 6.8 | 24 | 2.70 | 4/1 | 0.02 | — | Yes | S-1,S-2,S-3 |
| | Red-sensitive Layer | E2 | Tetr. | 0.25 | 0.55 | 1.0 | 9 | 2.80 | 0/4 | 0.70 | 15 | Yes | S-1,S-2,S-3 |
| | Intermediate-speed | H2 | Tetr. | 0.25 | 0.55 | 1.0 | 9 | 3.30 | 4/0 | 0.66 | 22 | Yes | S-4,S-5,S-6 |
| | Green-sensitive Layer | H3 | Tetr. | 0.20 | 0.40 | 1.0 | 11 | 3.00 | 0/5 | 0.62 | 22 | Yes | S-4,S-5,S-6 |
| | | J3 | Tetr. | 0.20 | 0.58 | 1.0 | 9 | 2.80 | 1/4 | 0.20 | 30 | Yes | S-4,S-5,S-6 |
| | High-speed | I2 | Tabular | 0.42 | 0.92 | 7.0 | 27 | 2.50 | 4/1 | 0.02 | — | Yes | S-4,S-5,S-6 |
| | Green-sensitive Layer | J2 | Tetr. | 0.20 | 0.58 | 1.0 | 9 | 2.80 | 1/4 | 0.70 | 17 | Yes | S-4,S-5,S-6 |

Tetd: Tetradecahedral

The high-speed blue-sensitive layer and intermediate-speed blue-sensitive layer of Samples 303 through 306 were each the same as those of Sample 302; into the 6th layer of Sample 306, 0.055 g/m2 of dye MF-1 was added in the form of solid particle dispersion, as prepared according to the method described in Japanese Patent Application No. 10-237120.

In the Table, the grain size is represented by a circular equivalent diameter; "VA-A" represents a coefficient of variation of grain size; and VA-B represents a coefficient of variation of (100) face. "(100) Ratio" represents a ration of (100) face to total grain surface, which was determined by the method described in Japanese Patent Application No. 10-362801. Formation of dislocation lines were observed in vicinity of the interface between core and shell of the grain.

Further, photographic material samples were each cut to Brownie size (i.e., 120 film size) and loaded into a camera (RZ67 Profesional, available from Mamiya OP Co. Ltd). Then, 10 scenes of plants and flowers in mountains, parks and botanical garden were photographed. In this case, photographing was freely conducted without being bound to the photographing conditions. Photographed samples were processed similarly to Example 1 or 2. The thus obtained print samples of five scenes for each sample were visually evaluated by 10 men and 10 women with respect to clarity of color reproduction and realism of nature, based five grades. Evaluation results are represented by the average value thereof, as shown in Table 11.

TABLE 10

| | Sensitivity Diff. (D = 1.0) | | E: Point γ | | SG | F:γ ratio | | |
|---|---|---|---|---|---|---|---|---|
| Sample | SG | SR | $\gamma^G$ | $\gamma^R$ | −SR | $\gamma^1$ | $\gamma^2$ | Remark |
| 301 | −0.30 | −0.18 | 2.15/1.15 | 2.00/1.35 | −0.22 | 1.17 | 0.93 | Comp. |
| 302 | −0.26 | −0.15 | 1.90/1.18 | 2.00/1.30 | −0.11 | 1.10 | 0.98 | Comp. |
| 303 | −0.25 | −0.17 | 1.94/1.23 | 2.05/1.28 | −0.08 | 1.06 | 1.04 | Inv. |
| 304 | −0.13 | −0.15 | 1.94/1.23 | 2.05/1.28 | 0.02 | 1.06 | 1.04 | Inv. |
| 305 | −0.17 | −0.13 | 1.90/1.25 | 1.90/1.20 | −0.04 | 0.96 | 1.00 | Inv. |
| 306 | −0.17 | −0.14 | 2.10/1.30 | 2.20/1.15 | −0.03 | 0.88 | 1.05 | Inv. |

TABLE 11

| Sample | Clearness | Nature Likeness | Remark |
|---|---|---|---|
| 301 | 2.7 | 2.6 | Comp. |
| 302 | 3.3 | 3.1 | Comp. |
| 303 | 4.2 | 4.1 | Inv. |
| 304 | 4.6 | 4.7 | Inv. |
| 305 | 4.3 | 4.2 | Inv. |
| 306 | 4.7 | 4.8 | Inv. |

In the table, E: Point γ represents the point-gamma (γ) at a density of 2.0/ density of 0.7;

$\gamma^1$ represents (point $\gamma^R$ of red-sensitive layer)÷(point $\gamma^G$ of red-sensitive layer) at a density of 0.7, and $\gamma^1$ represents (point $\gamma^R$ of red-sensitive layer)÷(point $\gamma^G$ of red-sensitive layer) at a density of 2.0.

Evaluation was done by 20 persons with respect to 5 scenes, based on five grades (in which "1" is a poor level, "5" is an excellent level and "3" is an ordinal level). The average values thereof are shown in Table 12.

As a result of visual judgment, Sample 302 exposed to green light or red light was improved in clearness, compared to Sample 301 but did not reach satisfactory levels. Samples 303 through 306, though some of them were inferior in the sensitivity difference or point γ to Sample 302, exhibited unexpectedly superior clearness and nature likeness; in particular, superior greenish tone variation and its balance with various flowers. Specifically, Sample 304 and 306 were superior in representation of shadows and the perception of depth thereof.

Example 4

Photographic material samples were prepared in such a manner that the sensitizing dye S-8 used in the blue-sensitive layer of Sample 104 in Example 1, Samples 204 and 206 in example 2 and Samples 304 and 305 in Example 3 was each change to an equivalent amount of sensitizing dye S-9, and chemical sensitization was optimally undergone. These five samples were evaluated with respect to spectral sensitivity of the blue-sensitive layer at a density of 1.0. The ratio (%) of sensitivity at 470 nm to the maximum sensitivity was as follows:

Sample 104 was 75% and sample changed to S-9 was 62%;

Sample 204 was 74% and sample changed to S-9 was 60%;

Sample 206 was 74% and sample changed to S-9 was 60%;

Sample 304 was 73% and sample changed to S-9 was 59%;

Sample 305 was 73% and sample changed to S -9 was 59%.

Further, samples were evaluated similarly to Examples 1, 2 and 3. As a result, it was proved that the use of dye S-9 exhibited superior results in texture representation.

Example 5

The ISO speed of each of samples prepared in Examples 1, 2 and 3 was determined according to the method described earlier and it was proved that all of the samples exhibited an ISO speed of not less than 200.

Example 6

Photographic material samples were prepared in such a manner that in Sample 105 in Example 1, Sample 206 in Example 2, and Samples 303 and 306 in Example 3, the following layer (interlayer) was provided between the 11th and 12th layers. The thus prepared samples were evaluated similarly to Example 1, 2 and 3, leading to preferred results similar to those of Sample 104, 206, 303 and 306. Layer newly provided (Interlayer)

| | |
|---|---|
| Compound (SC-1) | 0.20 |
| High boiling solvent (OIL-2) | 0.24 |
| Gelatin | 0.60 |

What is claimed is:

1. A silver halide color reversal photographic material comprising a support having thereon a blue-sensitive silver halide emulsion layer containing a yellow dye-forming coupler, a green-sensitive silver halide emulsion layer containing a magenta dye-forming coupler and a red-sensitive silver halide emulsion layer containing a cyan dye-forming coupler, wherein a RMS value at a density of 0.8 of the red-sensitive layer is within a range of 20 to 90% of a RMS value at a density of 0.8 of the green-sensitive layer.

2. The silver halide color reversal photographic material of claim 1, wherein at least one of the blue-sensitive, green-sensitive and red-sensitive layers exhibits a RMS value at a density of 0.8 within a range of 10 to 50% of a RMS value at a density of 1.6.

3. The silver halide color reversal photographic material of claim 1, wherein a sharpness at a spatial frequency of 20 lines/mm in a low density region of the red-sensitive layer is within a range of 80 to 150% of a sharpness at a spatial frequency of 20 lines/mm in a low density region of the green-sensitive layer.

4. The silver halide color reversal photographic material of claim 1, wherein at least one of the green-sensitive layer and red-sensitive layer exhibits a sharpness at a spatial frequency of 20 lines/mm in a high density region within a range of 120 to 200% of a sharpness at a spatial frequency of 20 lines/mm in a low density region.

5. The silver halide color reversal photographic material of claim 1, wherein the green-sensitive layer and the red-sensitive layer meet the following requirement:

$$-0.10 \leqq SG-SR \leqq 0.40$$

wherein SG is a difference in sensitivity at a density of 1.0 of the green-sensitive layer between exposure to green light and exposure to white light and SR is a difference in sensitivity at a density of 1.0 of the red-sensitive layer between exposure to red light and exposure to white light.

6. The silver halide color reversal photographic material of claim 1, wherein a point $\gamma$ of the red-sensitive layer and obtained by exposure to red light ($\gamma^R$) and a point $\gamma$ of the green-sensitive layer and obtained by exposure to green light ($\gamma^G$) meet the following requirement:

$$\gamma^1 \leqq \gamma^2$$

where $\gamma^1$ is a value of $\gamma^R/\gamma^G$ at a density of 0.7 and $\gamma^2$ is a value of $\gamma^R/\gamma^G$ at a density of 2.0.

7. The silver halide color reversal photographic material of claim 1, wherein at least one of the blue-sensitive, green-sensitive and red-sensitive layers comprises three silver halide emulsion layers different in speed.

8. The silver halide color reversal photographic material of claim 1, wherein the photographic material comprises at least three blue-sensitive silver halide emulsion layers containing an yellow dye-forming coupler and different in sensitivity, at least three green-sensitive silver halide emulsion layers containing a magenta dye-forming coupler and different in sensitivity and at least three red-sensitive silver halide emulsion layers containing a cyan dye-forming coupler and different in sensitivity.

9. The silver halide color reversal photographic material of claim 1, wherein the blue-sensitive layer exhibits a sensitivity at a density of 1.0 and a wavelength of 470 nm of the blue-sensitive layer, the sensitivity at a wavelength of 470 nm is within a range of 10 to 65% of the maximum sensitivity at a density of 1.0.

10. The silver halide color reversal photographic material of claim 1, wherein at least one of the blue-sensitive, green-sensitive and red-sensitive layers comprises at least a silver halide emulsion layer containing silver halide grains, said silver halide grains being tetradecahedral regular crystal grains and containing dislocation lines, and at least 50% of the total grain surface being accounted for by a (100) face.

11. The silver halide color reversal photographic material of claim 1, wherein the photographic material exhibits an ISO speed of not less than 200.

* * * * *